US009610682B2

(12) United States Patent
Shaner

(10) Patent No.: US 9,610,682 B2
(45) Date of Patent: Apr. 4, 2017

(54) FREE ARM WORKER SUPPORT

(71) Applicant: Harvey Dale Shaner, Belleview, FL (US)

(72) Inventor: Harvey Dale Shaner, Belleview, FL (US)

( * ) Notice: Subject to any disclaimer, the term of this patent is extended or adjusted under 35 U.S.C. 154(b) by 0 days.

(21) Appl. No.: 14/988,492

(22) Filed: Jan. 5, 2016

(65) Prior Publication Data

US 2016/0263741 A1 Sep. 15, 2016

Related U.S. Application Data

(60) Provisional application No. 62/124,792, filed on Jan. 5, 2015.

(51) Int. Cl.
*B25H 5/00* (2006.01)

(52) U.S. Cl.
CPC ..... *B25H 5/00* (2013.01)

(58) Field of Classification Search
CPC ..... B25H 5/00
USPC ..... 280/32.6, 79.11
See application file for complete search history.

(56) References Cited

U.S. PATENT DOCUMENTS

| | | | | |
|---|---|---|---|---|
| 3,148,892 A * | 9/1964 | Merriott | B25H 5/00 280/32.6 |
| 6,095,532 A * | 8/2000 | Martin | B25H 5/00 280/30 |
| 6,578,857 B1 * | 6/2003 | Whiteside | B25H 5/00 280/32.5 |
| 2003/0168824 A1 * | 9/2003 | Miles | B25H 5/00 280/32.6 |
| 2004/0227313 A1 * | 11/2004 | Shockley | B25H 5/00 280/32.6 |
| 2006/0237922 A1 * | 10/2006 | Forbis | B25H 5/00 280/32.6 |

FOREIGN PATENT DOCUMENTS

| | | | |
|---|---|---|---|
| GB | 2178702 A * | 2/1987 | B25H 5/00 |

* cited by examiner

*Primary Examiner* — Ruth Ilan

(57) ABSTRACT

A free arm worker support for floor and low wall workers includes a top section using a pillow type headrest and a specially designed head and body support deck. The head and body support deck has openings on each side that enable the worker to extend his arm and shoulder below while lying on his side. The head and body support deck is supported by a body support beam. A seat is supported by a seat support beam. The body support beam is pivotally attached by a pivot pin on a base section. The seat support beam is pivotally attached by a pivot pin on the base section. Each of the body and seat support beams are pivotally adjustable by adjustable struts using a lock pin locator. Riser blocks are used to provide space between the support beams and the base section to ensure a minimum free space for the workers arm and shoulder.

2 Claims, 1 Drawing Sheet

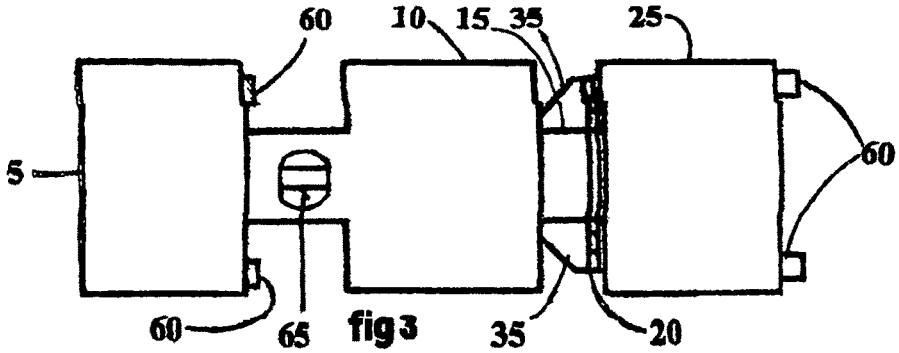
fig 3
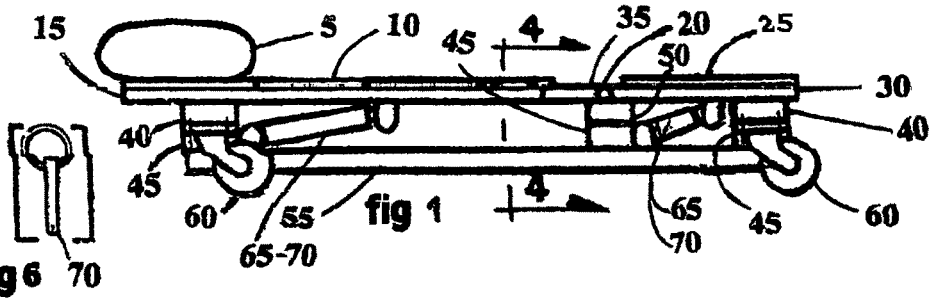
fig 1
fig 6
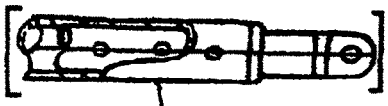
fig 5
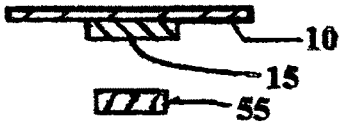
4-4
fig 4
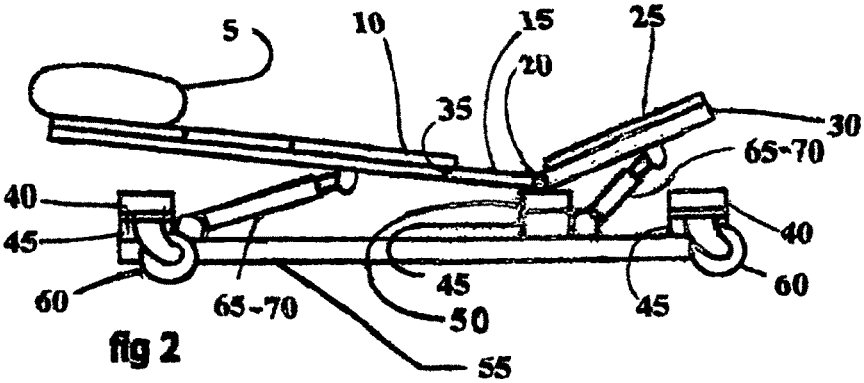
fig 2

FREE ARM WORKER SUPPORT

BACKGROUND OF THE INVENTION

A new design roller support for floor and low wall workers eliminates excessive and laborious work done by a worker, having to be on his knees, lying on the floor, or working in a bent over position.

BRIEF SUMMARY OF THE INVENTION

The Free Arm Worker Support (FAWS) supports the worker's body lying comfortably on either his left or right side. Both hands and arms are free to move, in the work area without interfering with anything. The free arm worker support is efficient in its production and pleasant to use.

The FAWS has a top section where a worker lies on either his left or right side to work on floors, low wall construction, or for repairs. The head and body support deck has openings on each side for a worker to extend his arms and shoulders below. The worker, lying on his side, rolls the FAWS on four easy rolling casters into a working position. After locking two casters, with tools in hand, the worker performs work with arms and hands free.

BRIEF DESCRIPTION OF THE SEVERAL VIEWS OF THE DRAWINGS

FIG. 1 is a front elevation view of the Free Arm Worker Support

FIG. 2 is a front elevation view showing adjustable features.

FIG. 3 is a top plan view showing the locations of the four casters and the adjustable strut for the body support.

FIG. 4 is a section view 4-4 showing a clear space on the left and right side under the body support deck.

FIG. 5 is a partial detail of the adjustable strut used for the body support and the seat support.

FIG. 6. Is a partial detail of the lock pin used with the adjustable strut.

DETAILED DESCRIPTION OF THE INVENTION

The Free Arm Worker Support (FAWS) has a top section where a worker lies on either his left or right side to work on floors, low wall construction, or for repairs. With reference to FIGS. 1-6, the head and body support deck 10 has openings on each side for a worker to extend his arm and shoulder below the body support deck as he lies on his side for free arm movement work. A pillow type head rest 5 is also included. The body support deck 10 has fasteners (not shown) to hold it in the worker's most advantageous position on a body support beam 15. The body support beam 15 includes slots (not shown) to accommodate the fasteners to allow for worker's height adjustment. The body support beam 15 further includes a stabilizer 35. A seat 25 is attached to the top of a seat support beam 30.

The top section of the FAWS is mounted on a base support beam 55. Each of the body support beam 15 and the seat support beam 30 are pivotally attached at one end to a pivot support beam 50 mounted on the base support beam 55. A pair of caster support beams 40 are located on either end of the base support beam 55. Each caster support beam 40 supports a pair of casters 60 on the end of the caster support beams 40. Riser or spacer blocks 45 are used to elevate the caster support beams 40 and the pivot support beam 50. As shown in FIG. 4, the purpose of the riser blocks is to elevate the top section of the FAWS in relation to the base support beam 55 so as to allow a minimum free space, under the top section for the worker's arm and shoulders and when the worker is lying on his right or left side when used in combination with the openings in the top section. The riser blocks are located one at each end and one in the middle, in relation to the base support beam 55 and as shown in FIGS. 1 and 2.

A worker may change the tilt level of the body support deck 10 and the seat 25 by a pair of adjustable struts 65. Each adjustable strut 65 is a two tube telescoping action device with a hand placed lock pin 70. The struts 65 are supported by the base support beam 55 to provide tilt for and support the pivotal body support beam 15 and the pivotal seat support beam 30. The body support deck 10 and body support beam 15 act as a unit, and the seat 25 and seat support beam 30 act as a unit.

The worker, lying on his side, rolls the FAWS on the four easy rolling casters 60 into a working position. After locking two casters, with tools in hand, the worker performs work with arms and hands free.

The invention claimed is:

1. A free arm worker support, for supporting a workers body lying on either his left or right side, comprising:

a head and body support deck having two sides, each of the two sides including an opening adapted so that a worker lying on his side may extend his arm and shoulder below the head and body support deck;

a top section including a body support beam supporting the head and body support deck, wherein the head and body support deck is attached to the top of the body support beam; wherein the top section further comprises a seat support beam supporting a seat attached to the top of the seat support beam;

a base support beam located below the body support beam and the seat support beam, a pair of caster support beams supported by opposite ends of the base support beam; wherein each caster support beam supports a pair of casters on opposite ends of the respective caster support beam;

a pivot support beam located longitudinally between the pair of caster support beams, wherein the body support beam and the seat support beam are pivotally attached to the pivot support beam;

three riser blocks, a first of the three riser blocks elevating a first of the pair of caster support beams in relation to the base support beam, a second of the three riser blocks elevating a second of the pair of caster support beams in relation to the base support beam, and a third of the three riser blocks elevating the pivot support beam in relation to the base support beam; the riser blocks configured to provide a minimum free space for the arm and shoulder of the worker under the top section when the head and body support deck is in a flat configuration;

wherein a tilt level of the body support deck is adjustable by a first adjustable strut located between and pivotally attached to the base support beam and the body support beam; and wherein a tilt level of the seat is adjustable by a second adjustable strut located between and pivotally attached to the base support beam and the seat support beam.

2. The free arm worker support of claim 1, wherein each of the first and second adjustable struts is a two tube telescoping action device with a hand placed lock pin.

* * * * *